US012747400B2

(12) United States Patent
Couderc et al.

(10) Patent No.: US 12,747,400 B2
(45) Date of Patent: Sep. 29, 2026

(54) METHOD FOR PRODUCING A LIGHT PETROL FRACTION HAVING A LOW SULPHUR CONTENT

(71) Applicant: IFP ENERGIES NOUVELLES, Rueil-Malmaison (FR)

(72) Inventors: Sophie Couderc, Rueil-Malmaison Cedex (FR); Marie Dehlinger, Rueil-Malmaison Cedex (FR); Adrien Gomez, Rueil-Malmaison Cedex (FR); Damien Hudebine, Rueil-Malmaison Cedex (FR); Marie-Claire Marion, Rueil-Malmaison Cedex (FR); Antoine Fecant, Rueil-Malmaison Cedex (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 205 days.

(21) Appl. No.: 18/721,447

(22) PCT Filed: Dec. 12, 2022

(86) PCT No.: PCT/EP2022/085357
§ 371 (c)(1),
(2) Date: Jun. 18, 2024

(87) PCT Pub. No.: WO2023/117532
PCT Pub. Date: Jun. 29, 2023

(65) Prior Publication Data

US 2025/0066680 A1 Feb. 27, 2025

(30) Foreign Application Priority Data

Dec. 20, 2021 (FR) ..... FR2114039

(51) Int. Cl.
*C10G 45/38* (2006.01)
*C10G 11/00* (2006.01)
(Continued)

(52) U.S. Cl.
CPC ..... *C10G 45/38* (2013.01); *C10G 11/00* (2013.01); *C10G 45/08* (2013.01); *C10G 65/06* (2013.01); *C10G 69/04* (2013.01)

(58) Field of Classification Search
CPC ..... C10G 45/38; C10G 11/00; C10G 45/08; C10G 65/06; C10G 69/04; C10G 45/06
See application file for complete search history.

(56) References Cited

U.S. PATENT DOCUMENTS 6,231,754 B1 5/2001 Brignac et al.
6,736,962 B1 5/2004 Cook et al.
(Continued)

FOREIGN PATENT DOCUMENTS

EP 2644683 A1 10/2013
FR 3099174 A1 1/2021

OTHER PUBLICATIONS

International Search Report PCT/EP2022/085357 dated Jan. 25, 2023 (pp. 1-2).

*Primary Examiner* — Randy Boyer
*Assistant Examiner* — Juan C Valencia
(74) *Attorney, Agent, or Firm* — Csaba Henter; MILLEN, WHITE, ZELANO & BRANIGAN

(57) ABSTRACT

Process for producing a light gasoline having a sulfur content of less than 10 ppm by weight, with respect to the total weight of the light gasoline, starting from a gasoline containing sulfur compounds, olefins and diolefins, which process includes a) a stage of selective hydrogenation to hydrogenate the diolefins and a reaction for increasing the molecular weight of a part of the sulfur compounds;

b) a stage separating the effluent obtained from stage a) into a gaseous fraction, a light gasoline cut and a heavy gasoline cut, stage b) being carried out in a fractionation column containing n plates, n being an integer of (Continued)

20 or more, the first plate being the reboiler and the plate "n" being the condenser, wherein the light gasoline cut is withdrawn from the fractionation column at the plate "n-i", with i being 1 to 10.

20 Claims, 2 Drawing Sheets

(51) Int. Cl.

| | |
|---|---|
| ***C10G 45/08*** | (2006.01) |
| ***C10G 65/06*** | (2006.01) |
| ***C10G 69/04*** | (2006.01) |

(56) References Cited

U.S. PATENT DOCUMENTS

| | | | | |
|---|---|---|---|---|
| 6,896,795 | B2 | 5/2005 | Didillon et al. | |
| 6,960,291 | B2 | 11/2005 | Greaney et al. | |
| 6,972,086 | B2 | 12/2005 | Didillon et al. | |
| 7,244,352 | B2 | 7/2007 | Halbert et al. | |
| 7,453,016 | B1 * | 11/2008 | Gajda | B01J 37/0221 585/277 |
| 7,799,210 | B2 | 9/2010 | Dysard et al. | |
| 9,505,686 | B2 | 11/2016 | Daudin et al. | |
| 2003/0230517 | A1 * | 12/2003 | Groten | C10G 45/08 208/217 |
| 2007/0114156 | A1 | 5/2007 | Greeley et al. | |
| 2008/0073250 | A1 * | 3/2008 | Bakshi | C10G 47/02 208/208 R |
| 2015/0181985 | A1 | 7/2015 | Norbert et al. | |
| 2018/0171244 | A1 | 6/2018 | Harandi | |
| 2022/0325191 | A1 | 10/2022 | Couderc et al. | |

* cited by examiner

METHOD FOR PRODUCING A LIGHT PETROL FRACTION HAVING A LOW SULPHUR CONTENT

FIELD OF THE INVENTION

The present invention relates to a process for reducing the content of sulfur compounds of a gasoline of olefinic type, so as to produce a "desulfurized" gasoline, while limiting the octane loss induced by the hydrogenation of the olefins.

STATE OF THE ART

The production of gasolines meeting new environmental standards requires that their sulfur content be significantly decreased.

It is furthermore known that conversion gasolines, and more particularly those originating from fluidized-bed catalytic cracking, which can represent from 30% to 50% of the gasoline pool, have high contents of monoolefins and of sulfur.

The sulfur present in gasolines is for this reason close to 90% attributable to the gasolines resulting from fluidized-bed catalytic cracking processes, which will be called FCC (Fluid Catalytic Cracking) gasolines subsequently. FCC gasolines thus constitute the preferred feedstock for the process of the present invention.

Among the possible routes for producing fuels having a low sulfur content, that which is very widely adopted consists in specifically treating sulfur-rich gasoline bases by catalytic hydrodesulfurization processes in the presence of hydrogen. Conventional processes desulfurize gasolines in a nonselective manner by hydrogenating a large part of the monoolefins, which causes a high loss in octane number and a high consumption of hydrogen. The most recent processes, such as the Prime G+ (trademark) process, make it possible to desulfurize cracked gasolines rich in olefins, while limiting the hydrogenation of the monoolefins and consequently the loss of octane number and the high hydrogen consumption which result therefrom. Such processes are, for example, described in the patent applications EP 1 077 247 and EP 1 174 485.

The residual sulfur compounds generally present in desulfurized gasoline can be separated into two distinct families: the unconverted refractory sulfur compounds present in the feedstock, on the one hand, and the sulfur compounds formed in the reactor by secondary "recombination" reactions. Among this last family of sulfur compounds, the predominant compounds are the mercaptans resulting from the addition of $H_2S$ formed in the reactor to the monoolefins present in the feedstock.

Mercaptans, of chemical formula R—SH, where R is an alkyl group, are also called recombinant mercaptans. Their formation or their decomposition obeys the thermodynamic equilibrium of the reaction between monoolefins and hydrogen sulfide to form recombinant mercaptans. An example is illustrated according to the following reaction:

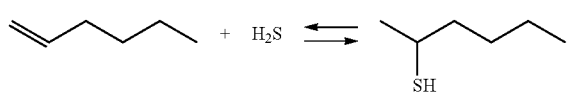

The sulfur contained in the recombinant mercaptans generally represents between 20% and 80% by weight of the residual sulfur in desulfurized gasolines.

The formation of recombinant mercaptans is in particular described in the patent U.S. Pat. No. 6,231,754 and the application WO01/40409, which teach various combinations of operating conditions and of catalysts making it possible to limit the formation of recombinant mercaptans.

Other solutions to the problem of the formation of recombinant mercaptans are based on a treatment of partially desulfurized gasolines in order to extract therefrom said recombinant mercaptans. Some of these solutions are described in the applications WO02/28988 or WO01/79391.

Still other solutions are described in the literature for desulfurizing FCC gasolines using a combination of stages of hydrodesulfurization and of removal of the recombinant mercaptans by reaction to give thioethers or disulfides (also called "sweetening") (see, for example, U.S. Pat. Nos. 7,799,210, 6,960,291, US2007/114156, EP 2 861 094).

The document US2018/0171244 discloses a process for the treatment of a gasoline comprising a stage of separation of the feedstock into a light gasoline cut and a heavy gasoline cut, in which the light gasoline cut is sent to a hydrodesulfurization unit with the aim of reducing the presence of sulfur in said light fraction. It is thus necessary to treat the light gasoline cut after separation in order to limit the amount of total sulfur contained in said light gasoline cut.

One aim of the present invention is to provide a process for the treatment of a gasoline containing sulfur compounds, olefins and diolefins in order to obtain directly a light gasoline having a low sulfur content and a low mercaptans content, while limiting the loss of octane number, and which can thus be sent directly to the gasoline pool for its use as fuel, without undergoing an additional treatment.

Subject Matters of the Invention

A subject matter of the present invention is a process for the production of a light gasoline (also referred to here as LCN or Light Cracked Naphtha gasoline) comprising a sulfur content of less than 10 ppm by weight, with respect to the total weight of said light gasoline, starting from a gasoline containing sulfur compounds, olefins and diolefins, the process comprising at least the following stages:

a) a stage of selective hydrogenation so as to hydrogenate the diolefins and to carry out a reaction for increasing the molecular weight of a part of the sulfur compounds, in which process the gasoline and the hydrogen are brought into contact with a selective hydrogenation catalyst at a temperature of between 100° C. and 220° C., with a liquid space velocity of between 1 $h^{-1}$ and 7 $h^{-1}$ and a pressure of between 0.5 MPa and 5 MPa, and with a molar ratio of the hydrogen to the diolefins to be hydrogenated of greater than 1 mol/mol and less than 100 mol/mol, with a ratio of the hydrogen flow rate, expressed in standard $m^3$ per hour, to the flow rate of feedstock to be treated, expressed in $m^3$ per hour at standard conditions, of between 2 $Sm^3/m^3$ and 100 $Sm^3/m^3$, said selective hydrogenation catalyst comprising an active phase containing at least one metal from group VIB and at least one metal from group VIII and a porous support containing at least alumina, said catalyst comprising a specific surface of between 100 $m^2/g$ and 400 $m^2/g$;

b) a stage of separation of the effluent obtained on conclusion of stage a) into a gaseous fraction, a light gasoline (LCN) cut and a heavy gasoline (also referred to here as HCN or Heavy Cracked Naphtha) cut, said stage b) being carried out in a fractionation column comprising n plates, n being an integer of greater than or equal to 20, the first plate being the reboiler and the plate "n" being the condenser, it being understood that the light gasoline (LCN) cut is withdrawn from said fractionation column at the plate "n-i", with i of between 1 and 10.

The applicant company has discovered, surprisingly, that it is possible to obtain directly a light gasoline cut meeting the required specifications and enriched in olefins starting from a gasoline feedstock containing sulfur compounds, olefins and diolefins by carrying out a stage of selective hydrogenation of said gasoline feedstock under specific operating conditions and in the presence of a specific catalyst, followed by a stage of separation of the effluent obtained on conclusion of the selective hydrogenation stage, the separation being carried out in a fractionation column with a withdrawal of the light gasoline cut at a very specific level of the column.

According to one or more embodiments, said fractionation column comprises between 20 and 100 plates.

According to one or more embodiments, said light gasoline cut is withdrawn from said fractionation column at the plate "n-i", with i of between 1 and 6.

According to one or more embodiments, said metal from group VIII is nickel.

According to one or more embodiments, said metal from group VIB is molybdenum.

According to one or more embodiments, stage a) is carried out in the presence of a catalyst comprising nickel at a content by weight of nickel oxide, in NiO form, of between 1% and 12% and molybdenum at a content by weight of molybdenum oxide, in $MoO_3$ form, of between 6% and 18% and a nickel/molybdenum molar ratio of between 0.3 and 2.5, the metals being deposited on a support consisting of alumina.

According to one or more embodiments, said catalyst comprises a specific surface of between 100 $m^2/g$ and 280 $m^2/g$.

According to one or more embodiments, the process additionally comprises a stage c) of hydrodesulfurization of the heavy gasoline HCN cut obtained on conclusion of stage b) in the presence of hydrogen and of a hydrodesulfurization catalyst comprising an oxide support and an active phase comprising a metal from group VIB and a metal from group VIII, at a temperature of between 210° C. and 320° C., at a pressure of between 1 MPa and 4 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$, so as to convert at least a part of the sulfur compounds into $H_2S$.

According to one or more embodiments, the hydrodesulfurization catalyst of stage c) comprises alumina and an active phase comprising cobalt, molybdenum and optionally phosphorus, said hydrodesulfurization catalyst containing a content by weight, with respect to the total weight of catalyst, of cobalt oxide, in CoO form, of between 0.1% and 10%, a content by weight, with respect to the total weight of catalyst, of molybdenum oxide, in $MoO_3$ form, of between 1% and 20%, a cobalt/molybdenum molar ratio of between 0.1 and 0.8 and a content by weight, with respect to the total weight of catalyst, of phosphorus oxide, in $P_2O_5$ form, of between 0.3% and 10%, when phosphorus is present, said hydrodesulfurization catalyst having a specific surface of between 50 $m^2/g$ and 250 $m^2/g$.

According to one or more embodiments, the process additionally comprises a stage d) of finishing hydrodesulfurization of the effluent obtained on conclusion of stage c) without removal of the $H_2S$ formed, in the presence of hydrogen and of a hydrodesulfurization catalyst comprising an oxide support and an active phase constituted of at least one metal from group VIII, at a temperature of between 280° C. and 400° C., at a pressure of between 0.5 MPa and 5 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$.

According to one or more embodiments, the hydrodesulfurization catalyst of stage d) is constituted of alumina and of nickel, said hydrodesulfurization catalyst containing a content by weight, with respect to the total weight of catalyst, of nickel oxide, in NiO form, of between 5% and 20%, said hydrodesulfurization catalyst having a specific surface of between 30 $m^2/g$ and 180 $m^2/g$.

According to one or more embodiments, the process additionally comprises a stage e) of separation of the $H_2S$ formed and present in the effluent resulting from stage d).

According to one or more embodiments, the gasoline is a catalytic cracking gasoline.

DETAILED DESCRIPTION

Definitions

Figure 1:
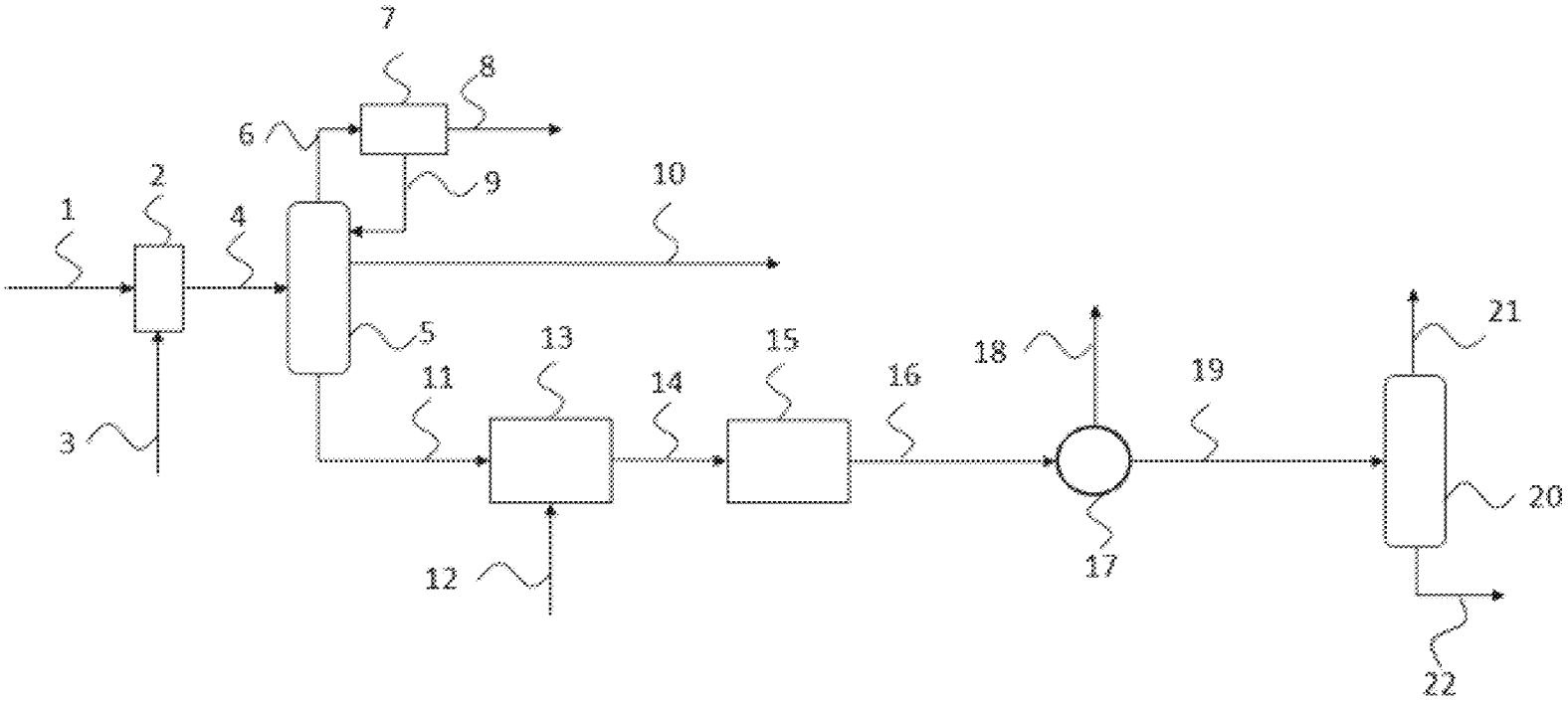
FIG. 1 is a diagrammatic representation of the process according to the invention.

Subsequently, the groups of chemical elements are given according to the CAS classification (CRC Handbook of Chemistry and Physics, published by CRC Press, editor-in-chief D. R. Lide, 81$^{st}$ edition, 2000-2001). For example, group VIII according to the CAS classification corresponds to the metals of columns 8, 9 and 10 according to the new IUPAC classification.

Specific surface is understood to mean the BET specific surface ($S_{BET}$ in $m^2/g$) determined by nitrogen adsorption in accordance with the standard ASTM D 3663-78 established from the Brunauer-Emmett-Teller method described in the journal *The Journal of the American Chemical Society,* 1938, 60, 309.

Total pore volume of the catalyst or of the support used for the preparation of the catalyst is understood to mean the volume measured by mercury intrusion porosimetry according to the standard ASTM D4284 at a maximum pressure of 4000 bar (400 MPa), using a surface tension of 484 dynes/cm and a contact angle of 140°, for example with an Autopore III model appliance of the Micromeritics® brand.

The wetting angle used was taken as equal to 140° following the recommendations of the publication "Techniques de l'ingénieur, traité analyse et caractérisation" [Techniques of the Engineer, Analysis and Characterization Treatise], pages 1050-1055, written by Jean Charpin and Bernard Rasneur. In order to obtain better accuracy, the value of the total pore volume corresponds to the value of the total pore volume measured by mercury intrusion porosimetry measured on the sample minus the value of the total pore volume measured by mercury intrusion porosimetry measured on the same sample for a pressure corresponding to 30 psi (approximately 0.2 MPa).

The contents of elements from group VIII, elements from group VIB and phosphorus are measured by X-ray fluorescence.

Process

The present invention relates to a process for the production of a light gasoline comprising a sulfur content of less than 10 ppm by weight, with respect to the total weight of said light gasoline, starting from a gasoline containing sulfur compounds, olefins and diolefins, the process comprising at least the following stages:

a) a stage of selective hydrogenation so as to hydrogenate the diolefins and to carry out a reaction for increasing the molecular weight of a part of the sulfur compounds, in which process the gasoline and the hydrogen are brought into contact with a selective hydrogenation catalyst at a temperature of between 100° C. and 220° C., with a liquid space velocity of between 1 $h^{-1}$ and 7 $h^{-1}$ and a pressure of between 0.5 MPa and 5 MPa, and with a molar ratio of the hydrogen to the diolefins to be hydrogenated of greater than 1 mol/mol and less than 100 mol/mol, with a ratio of the hydrogen flow rate, expressed in standard $m^3$ per hour, to the flow rate of feedstock to be treated, expressed in $m^3$ per hour at standard conditions, of between 2 $Sm^3/m^3$ and 100 $Sm^3/m^3$, said selective hydrogenation catalyst comprising an active phase containing at least one metal from group VIB and at least one metal from group VIII and a porous support containing at least alumina, said catalyst comprising a specific surface of between 100 $m^2/g$ and 400 $m^2/g$;

b) a stage of separation of the effluent obtained on conclusion of stage a) into a gaseous fraction, a light gasoline cut and a heavy gasoline cut, said stage b) being carried out in a fractionation column comprising "n" plates, n being an integer of greater than or equal to 20, the first plate being the reboiler (that is to say, at the bottom of the fractionation column) and the plate "n" being the condenser (that is to say, at the top of the fractionation column), it being understood that the light gasoline cut is withdrawn from said fractionation column at the plate "n-i", with i of between 1 and 10;

c) optionally, a stage of hydrodesulfurization of the heavy gasoline cut obtained on conclusion of stage b) in the presence of hydrogen and of a hydrodesulfurization catalyst comprising an oxide support and an active phase comprising a metal from group VIB and a metal from group VIII, at a temperature of between 210° C. and 320° C., at a pressure of between 1 MPa and 4 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$, so as to convert at least a part of the sulfur compounds into $H_2S$;

d) optionally, a stage of finishing hydrodesulfurization of the effluent obtained on conclusion of stage c) without removal of the $H_2S$ formed, in the presence of hydrogen and of a hydrodesulfurization catalyst comprising an oxide support and an active phase constituted of at least one metal from group VIII, at a temperature of between 280° C. and 400° C., at a pressure of between 0.5 MPa and 5 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$;

e) optionally, a stage of separation of the $H_2S$ formed and present in the effluent resulting from stage d).

Description of the Feedstock

The process according to the invention makes it possible to treat any type of gasoline cut containing sulfur-comprising compounds, olefins and diolefins, such as, for example, a cut resulting from a coking, visbreaking, steam cracking or fluidized-bed catalytic cracking (FCC, Fluid Catalytic Cracking) unit. This gasoline can optionally be composed of a significant fraction of gasoline originating from other production processes, such as atmospheric distillation (gasoline resulting from a direct distillation (or straight run gasoline)), or from conversion processes (coking or steam cracked gasoline). Said feedstock preferably consists of a gasoline cut resulting from a catalytic cracking unit.

The feedstock is a gasoline cut containing sulfur compounds and olefins, the boiling point range of which typically extends from the boiling points of the hydrocarbons having 2 or 3 carbon atoms (C2 or C3) up to 260° C., preferably from the boiling points of the hydrocarbons having 2 or 3 carbon atoms (C2 or C3) up to 220° C., more preferably from the boiling points of the hydrocarbons having 5 carbon atoms up to 220° C. The process according to the invention can also treat feedstocks having lower end points than those mentioned above, such as, for example, a C5-180° C. cut.

The sulfur content of the gasoline cuts produced by FCC depends on the sulfur content of the feedstock treated by the FCC, on the presence or not of a pretreatment of the feedstock of the FCC, as well as on the end point of the cut. Generally, the sulfur contents of the whole of a gasoline cut, in particular if it originates from the FCC, are greater than 100 ppm by weight, and most of the time greater than 500 ppm by weight. For gasolines having end points of greater than 200° C., the sulfur contents are often greater than 1000 ppm by weight; they can even, in some cases, reach values of the order of 4000 ppm to 5000 ppm by weight.

The feedstock treated by the process according to the invention can be a feedstock containing sulfur compounds in a content of greater than 1000 ppm by weight of sulfur and often of greater than 1500 ppm.

Furthermore, the gasolines resulting from FCC units contain, on average, between 0.5% and 5% by weight of diolefins, between 20% and 50% by weight of olefins and between 10 ppm and 0.5% by weight of sulfur, including generally less than 300 ppm of mercaptans.

Stage a): Selective Hydrogenation

The selective hydrogenation according to stage a) of the process according to the invention consists mainly in:

selectively hydrogenating the diolefins to give monoolefins;

transforming the saturated light sulfur compounds and mainly the mercaptans into heavier sulfides or mercaptans by reaction with the monoolefins;

isomerizing the monoolefin compounds having their C=C double bond in the external position to give their isomer having their C=C double bond in the internal position.

The reactions for the hydrogenation of the diolefins to give monoolefins are illustrated below by the transformation of 1,3-pentadiene, an unstable compound, which can easily be hydrogenated to give 2-pentene. However, it is sought to limit the side reactions of hydrogenation of the monoolefins which, in the example below, would result in the formation of n-pentane.

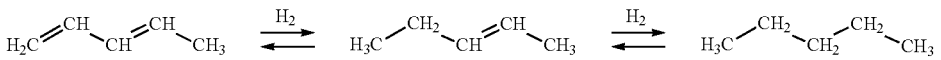

The sulfur compounds which it is sought to transform are mainly the mercaptans. The main reaction for transformation of the mercaptans consists of a thioetherification reaction between the monoolefins and the mercaptans. This reaction is illustrated below by the addition of propane-2-thiol to 2-pentene to form a propyl pentyl sulfide.

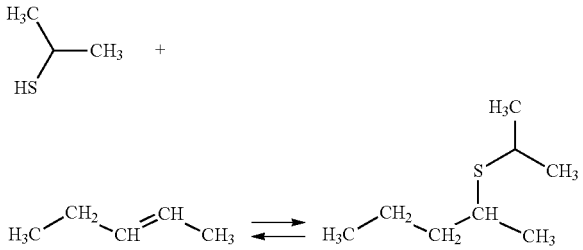

In the presence of hydrogen, the transformation of the sulfur compounds can also pass through the intermediate formation of $H_2S$, which can subsequently be added to the unsaturated compounds present in the feedstock. However, this route is a minor one under the preferred conditions of the reaction.

In addition to the mercaptans, the compounds likely to be thus transformed and increased in molecular weight are the sulfides and mainly $CS_2$, COS, thiophane or methylthiophane. In some cases, it is possible to observe reactions in which the molecular weight of light nitrogenous compounds, and mainly nitriles, pyrrole and its derivatives, is increased. According to the invention, the catalyst also makes it possible to carry out an isomerization of the monoolefinic compounds having their C=C double bond in the external position to give their isomer having their C=C double bond in the internal position.

This reaction is illustrated below by the isomerization of 1-hexene to give 2-hexene or 3-hexene.

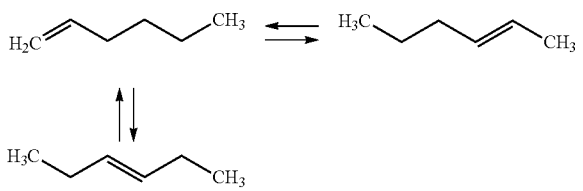

In the selective hydrogenation process according to the invention, the feedstock to be treated is mixed with hydrogen before being brought into contact with the catalyst. The amount of hydrogen injected is such that the molar ratio of the hydrogen to the diolefins to be hydrogenated is greater than 1 (stoichiometry) and less than 100, and preferably of between 1 and 10 mol/mol. Too large an excess of hydrogen can lead to high hydrogenation of the monoolefins and consequently to a decrease in the octane number of the gasoline.

All of the feedstock is generally injected at the inlet of the reactor. However, it can be advantageous, in some cases, to inject a fraction or all of the feedstock between two consecutive catalytic beds placed in the reactor. This embodiment makes it possible in particular to continue to operate the reactor if the inlet of the reactor is clogged by deposits of polymers, of particles or of gums present in the feedstock.

The mixture consisting of the gasoline and of the hydrogen is brought into contact with the catalyst at a temperature of between 100° C. and 220° C. and preferably between 110° C. and 200° C., with a liquid space velocity (HSV) of between 1 $h^{-1}$ and 7 $h^{-1}$, the unit of the liquid space velocity being the volume in $m^3$ per hour at standard conditions, per $m^3$ of catalyst. The pressure is adjusted so that the reaction mixture is predominantly in liquid form in the reactor. The pressure is of between 0.5 MPa and 5 MPa and preferably between 1 MPa and 4 MPa.

The reaction for the selective hydrogenation of the diolefins and for increasing the molecular weight of the light mercaptans is preferentially carried out over a catalyst comprising at least one metal from group VIII and at least one metal from group VIB and a porous support containing at least alumina.

The content of metal from group VIII of the active phase, measured in oxide form, is of between 1% and 20% by weight, with respect to the total weight of the catalyst, preferably between 2% and 15% by weight and more preferentially still between 4% and 13% by weight. The metal from group VIII is preferably chosen from nickel, cobalt and iron. More preferably, the metal from group VIII is nickel.

The content of metal from group VIB of the active phase, measured in oxide form, is of between 1% and 18% by weight, with respect to the total weight of the catalyst, preferably between 1% and 15% by weight and more preferentially still between 2% and 13% by weight. The metal from group VIB is preferably chosen from molybdenum and tungsten. More preferably, the metal from group VIB is molybdenum.

The element from group VIII is preferably chosen from nickel and cobalt and in particular nickel. The element from group VIB is preferably chosen from molybdenum and tungsten and in a preferred way molybdenum.

According to the invention, the catalyst used in the selective hydrogenation stage exhibits a specific surface of between 100 $m^2/g$ and 400 $m^2/g$, preferably of between 100 $m^2/g$ and 300 $m^2/g$, preferably of between 100 $m^2/g$ and 280 $m^2/g$.

The specific surface is determined in the present invention by the B.E.T. method according to the standard ASTM D3663, as described in the work by Rouquerol F., Rouquerol J. and Sing K., *Adsorption by Powders and Porous Solids: Principles, Methodology and Applications*, Academic Press, 1999, for example by means of an Autopore III™ model device of the Micromeritics™ brand.

The pore volume of the selective hydrogenation catalyst is generally of between 0.4 $cm^3/g$ and 1.3 $cm^3/g$, preferably of between 0.5 $cm^3/g$ and 1.1 $cm^3/g$.

The total pore volume is measured by mercury porosimetry according to the standard ASTM D4284 with a wetting angle of 140°, as described in the same work.

According to a preferred embodiment, the selective hydrogenation catalyst contains nickel at a content by weight of nickel oxide, in NiO form, of between 1% and 12%, and molybdenum at a content by weight of molybdenum oxide, in $MoO_3$ form, of between 6% and 18% and a nickel/molybdenum molar ratio of between 0.3 and 2.5, the metals being deposited on a support constituted of alumina, said catalyst exhibiting a specific surface of between 100 $m^2/g$ and 400 $m^2/g$, preferably of between 100 $m^2/g$ and 300 $m^2/g$, preferably of between 100 $m^2/g$ and 280 $m^2/g$. The degree of sulfidation of the metals constituting the catalyst is preferably greater than 60%.

After selective hydrogenation, the content of diolefins, determined via the maleic anhydride value (MAV), according to the UOP 326 method, is generally reduced to less than 6 mg of maleic anhydride/g (MA/g), indeed even less than 4 mg MA/g and more preferably less than 2 mg MA/g. In some cases, less than 1 mg MA/g may be obtained.

Stage b): Separation

The effluent obtained on conclusion of stage a) is subsequently sent to a fractionation column (also referred to as "splitter") in order to obtain a gaseous fraction, a light gasoline (LCN) cut and a heavy gasoline (HCN) cut.

According to an essential aspect of the invention, stage b) is carried out in a fractionation column comprising "n" plates, n being an integer of greater than or equal to 20, the first plate being the reboiler and the plate "n" being the condenser, it being understood that the light gasoline is withdrawn from said fractionation column at the plate "n-i", with i of between 1 and 10, preferably between 2 and 6 and more preferentially between 3 and 6. The number "n" of plates of the fractionation column is preferably of between 20 and 100, preferably between 20 and 60.

The fractionation column generally operates at a pressure of between 0.1 MPa and 2 MPa and preferably between 0.2 MPa and 1 MPa.

Make up with hydrogen can be carried out in the column in order to maintain the pressure in the event of complete hydrogen consumption during stage a) of the process according to the invention.

Advantageously, the fractionation column comprises a reboiler, the reboiling steam of which is at a temperature of less than 260° C. in order to limit the subsequent cracking ("back cracking") of the heavy mercaptans to give light mercaptans in the heavy gasoline cut.

The reflux ratio, expressed as being the ratio of the liquid traffic in the column divided by the distillate flow rate expressed in kg/h, is generally less than 1, preferably less than 0.9.

The gaseous fraction is obtained by condensation of the gas phase produced at the top of the fractionation column and then by gas/liquid separation, which makes possible the removal of the hydrogen present in the effluent obtained on conclusion of stage a) and the production of a liquid phase consisting of the $C_5$ to $C_7$ hydrocarbon compounds entrained at the column top, which is returned as reflux into the column. The condensation is generally carried out by cooling to a temperature of between 40° C. and 65° C. The liquid reflux makes it possible to control the temperature at the column top, thus making possible control of the sulfur content of the light fraction of the gasoline.

Thus, preferably:

- the gaseous fraction predominantly comprises hydrogen, possibly C1 to C4 hydrocarbon compounds which may originate from the hydrogen makeup gas stream;
- the light gasoline LCN cut is a $C5^-$ hydrocarbon cut (i.e. containing hydrocarbons having 5 and less than 5 carbon atoms per molecule);
- the heavy gasoline HCN cut is a $C6^+$ cut (i.e. containing hydrocarbons which can have 6 and more than 6 carbon atoms per molecule).

Advantageously, the total sulfur content of the light gasoline is less than 10 ppm by weight. The light gasoline obtained does not require an additional hydrodesulfurization stage and can be sent directly to the gasoline pool.

Step (c): Hydrodesulfurization of the Heavy Gasoline (HCN) Cut [Optional]

The hydrodesulfurization stage c) can be carried out in order to reduce the sulfur content of the heavy gasoline (HCN) to be treated by converting the sulfur compounds into $H_2S$, which can be subsequently removed in stage e).

The hydrodesulfurization stage c) consists in bringing the heavy gasoline to be treated into contact with hydrogen, in one or more hydrodesulfurization reactors, containing one or more catalysts suitable for carrying out the hydrodesulfurization.

According to a preferred embodiment of the invention, stage c) is carried out with the aim of performing a hydrodesulfurization selectively, that is to say with a degree of hydrogenation of the monoolefins of less than 80%, preferably of less than 70% and very preferably of less than 60%.

The temperature is generally between 210° C. and 320° C. and preferably between 220° C. and 290° C. The temperature employed must be sufficient to maintain the gasoline to be treated in the vapor phase in the reactor. In the case where the hydrodesulfurization stage c) is carried out in several reactors in series, the temperature of each reactor is generally greater by at least 5° C., preferably by at least 10° C. and very preferably by at least 30° C. than the temperature of the reactor which precedes it.

The operating pressure of this stage is generally of between 1 MPa and 4 MPa and preferably of between 1.5 MPa and 3 MPa.

The amount of catalyst employed in each reactor is generally such that the ratio of the flow rate of gasoline to be treated, expressed in $m^3$ per hour at standard conditions, per $m^3$ of catalyst (also referred to as space velocity) is of between 1 $h^{-1}$ and 10 $h^{-1}$ and preferably between 2 $h^{-1}$ and 8 $h^{-1}$.

The hydrogen flow rate is generally such that the ratio of the hydrogen flow rate, expressed in standard $m^3$ per hour ($Sm^3/h$), to the flow rate of feedstock to be treated, expressed in $m^3$ per hour at standard conditions (15° C., 0.1 MPa), is of between 100 $Sm^3/m^3$ and 600 $Sm^3/m^3$, preferably between 200 $Sm^3/m^3$ and 500 $Sm^3/m^3$. Standard $m^3$ is understood to mean the amount of gas in a volume of 1 $m^3$ at 0° C. and 0.1 MPa.

The hydrogen required for this stage can be fresh hydrogen or recycled hydrogen, preferably freed from $H_2S$, or a mixture of fresh hydrogen and of recycled hydrogen. Preferably, fresh hydrogen will be used.

The degree of desulfurization of stage c), which depends on the sulfur content of the feedstock to be treated, is generally greater than 50% and preferably greater than 70%, so that the product resulting from stage c) contains less than 100 ppm by weight of sulfur and preferably less than 50 ppm by weight of sulfur.

The catalyst used in stage c) must exhibit a good selectivity with regard to the hydrodesulfurization reactions, in comparison with the reaction for the hydrogenation of olefins.

The hydrodesulfurization catalyst of stage c) comprises an oxide support and an active phase comprising a metal from group VIB and a metal from group VIII and optionally phosphorus and/or an organic compound as described below.

The metal from group VIB present in the active phase of the catalyst is preferentially chosen from molybdenum and tungsten. The metal from group VIII present in the active phase of the catalyst is preferentially chosen from cobalt, nickel and the mixture of these two elements.

The active phase of the catalyst is preferably chosen from the group formed by the combination of the elements nickel-molybdenum, cobalt-molybdenum and nickel-cobalt-molybdenum and very preferably the active phase consists of cobalt and molybdenum.

The content of metal from group VIII is of between 0.1% and 10% by weight of oxide of the metal from group VIII, with respect to the total weight of the catalyst, preferably of between 0.6% and 8% by weight, preferably of between 0.6% and 7% by weight, very preferably of between 1% and 6% by weight.

The content of metal from group VIB is of between 1% and 20% by weight of oxide of the metal from group VIB, with respect to the total weight of the catalyst, preferably of between 2% and 18% by weight, very preferably of between 3% and 16% by weight.

The metal from group VIII to metal from group VIB molar ratio of the catalyst is generally of between 0.1 and 0.8, preferably of between 0.2 and 0.6.

Optionally, the catalyst can additionally exhibit a phosphorus content generally of between 0.3% and 10% by weight of $P_2O_5$, with respect to the total weight of catalyst, preferably between 0.3% and 5% by weight, very preferably between 0.5% and 3% by weight. For example, the phosphorus present in the catalyst is combined with the metal from group VIB and optionally also with the metal from group VIII in the form of heteropolyanions. Furthermore, the phosphorus/(metal from group VIB) molar ratio is generally of between 0.1 and 0.7, preferably of between 0.2 and 0.6, when phosphorus is present.

Preferably, the catalyst is characterized by a specific surface of between 5 $m^2/g$ and 400 $m^2/g$, preferably of between 10 $m^2/g$ and 250 $m^2/g$, preferably of between 50 $m^2/g$ and 250 $m^2/g$. The specific surface is determined in the present invention by the B.E.T. method according to the standard ASTM D3663, as described in the work by Rouquerol F., Rouquerol J. and Sing K., *Adsorption by Powders and Porous Solids: Principles, Methodology and Applications*, Academic Press, 1999, for example by means of an Autopore III™ model device of the Micromeritics™ brand.

The total pore volume of the catalyst is generally of between 0.4 $cm^3/g$ and 1.3 $cm^3/g$, preferably of between 0.6 $cm^3/g$ and 1.1 $cm^3/g$. The total pore volume is measured by mercury porosimetry according to the standard ASTM D4284 with a wetting angle of 140°, as described in the same work.

The tapped bulk density (TBD) of the catalyst is generally of between 0.4 g/ml and 0.8 g/ml, preferably of between 0.4 g/ml and 0.7 g/ml. The TBD measurement consists in introducing the catalyst into a measuring cylinder, the volume of which has been determined beforehand, and then, by vibration, in tapping it until a constant volume is obtained. The bulk density of the tapped product is calculated by comparing the weight introduced and the volume occupied after tapping.

The catalyst can be in the form of cylindrical or multilobe (trilobe, quadrilobe, and the like) extrudates with a small diameter, or of spheres.

The oxide support of the catalyst is usually a porous solid chosen from the group consisting of: aluminas, silica, silica-aluminas and also titanium or magnesium oxides, used alone or as a mixture with alumina or silica-alumina. It is preferably chosen from the group consisting of silica, the family of transition aluminas and alumina silicas. Very preferably, the oxide support is constituted essentially of alumina, that is to say it comprises at least 51% by weight, preferably at least 60% by weight, very preferably at least 80% by weight, or even at least 90% by weight of alumina. It preferably consists solely of alumina. Preferably, the oxide support of the catalyst is a "high temperature" alumina, that is to say which contains theta-, delta-, kappa- or alpha-phase aluminas, alone or as a mixture, and an amount of less than 20% of gamma-, chi- or eta-phase alumina.

The catalyst can also additionally comprise at least one organic compound containing oxygen and/or nitrogen and/or sulfur before sulfidation.

A very preferred embodiment of the invention corresponds to the use, for stage c), of a catalyst comprising alumina and an active phase comprising cobalt, molybdenum and optionally phosphorus, said catalyst containing a content by weight, with respect to the total weight of catalyst, of cobalt oxide, in CoO form, of between 0.1% and 10%, a content by weight, with respect to the total weight of catalyst, of molybdenum oxide, in $MoO_3$ form, of between 1% and 20%, a cobalt/molybdenum molar ratio of between 0.1 and 0.8 and a content by weight, with respect to the total weight of catalyst, of phosphorus oxide, in $P_2O_5$ form, of between 0.3% and 10%, when phosphorus is present, said catalyst having a specific surface of between 50 $m^2/g$ and 250 $m^2/g$. According to one embodiment, the active phase consists of cobalt and molybdenum. According to another embodiment, the active phase consists of cobalt, molybdenum and phosphorus.

Stage d): Finishing Hydrodesulfurization [Optional]

During the hydrodesulfurization stage d), a large part of the sulfur compounds is converted into $H_2S$. The remaining sulfur compounds are essentially refractory sulfur compounds and the recombinant mercaptans resulting from the addition of $H_2S$ formed in stage c) to the monoolefins present in the feedstock.

This "finishing" hydrodesulfurization stage is mainly employed to reduce the content of the recombinant mercaptans. Preferably, stage d) is carried out at a higher temperature than that of stage c). This is because, by using a higher temperature in this stage compared to the temperature of stage c), the formation of olefins and of $H_2S$ will be favored by the thermodynamic equilibrium. Stage d) also makes it possible to hydrodesulfurize the more refractory sulfur compounds.

The hydrodesulfurization stage d) consists in bringing the effluent from stage c) optionally into contact with an addition of hydrogen, in one or more hydrodesulfurization reactors, containing one or more catalysts suitable for carrying out the hydrodesulfurization.

The hydrodesulfurization stage d) is carried out without significant hydrogenation of the olefins. The degree of hydrogenation of the olefins of the catalyst of the hydrodesulfurization stage d) is generally less than 5% and more generally still less than 2%.

The temperature of this stage is generally of between 280° C. and 400° C., more preferably between 290° C. and 380° C. and very preferably between 300° C. and 360° C. The temperature of this stage d) is generally greater by at least 5° C., preferably by at least 10° C. and very preferably by at least 30° C. than the temperature of stage c).

The operating pressure of this stage is generally of between 0.5 MPa and 5 MPa and preferably of between 1 MPa and 3 MPa.

The amount of catalyst employed in each reactor is generally such that the ratio of the flow rate of gasoline to be treated, expressed in $m^3$ per hour at standard conditions, per $m^3$ of catalyst (also referred to as space velocity) is of between 1 $h^{-1}$ and 10 $h^{-1}$ and preferably between 2 $h^{-1}$ and 8 $h^{-1}$.

Preferably, the hydrogen flow rate is subject and equal to the amount injected in stage c) decreased by the hydrogen consumed in stage c). The hydrogen flow rate is generally such that the ratio of the hydrogen flow rate, expressed in standard $m^3$ per hour ($Sm^3/h$), to the flow rate of feedstock to be treated, expressed in $m^3$ per hour at standard conditions (15° C., 0.1 MPa), is of between 100 $Sm^3/m^3$ and 600 $Sm^3/m^3$, preferably between 200 $Sm^3/m^3$ and 500 $Sm^3/m^3$.

The degree of desulfurization of stage d), which depends on the sulfur content of the feedstock to be treated, is generally greater than 50% and preferably greater than 70%, so that the product resulting from stage d) contains less than 60 ppm by weight of sulfur and preferably less than 40 ppm by weight of sulfur and very preferably less than 20 ppm by weight of sulfur.

The hydrodesulfurization stages c) and d) can be carried out either in a single reactor containing both catalysts or in at least two different reactors. When stages c) and d) are carried out using two reactors, these two reactors are placed in series, the second reactor treating all of the effluent exiting from the first reactor (without separation of the liquid and of the gas between the first and the second reactor).

The catalyst of stage d) is different in nature and/or in composition from that used in stage c). The catalyst of stage d) is in particular a very selective hydrodesulfurization catalyst: it makes it possible to hydrodesulfurize without hydrogenating the olefins and thus to maintain the octane number.

The catalyst which may be suitable for this stage d) of the process according to the invention, without this list being limiting, is a catalyst comprising an oxide support and an active phase constituted by at least one metal from group VIII and preferably chosen from the group formed by nickel, cobalt and iron. These metals can be used alone or in combination.

Preferably, the active phase consists of a metal from group VIII, preferably nickel. Particularly preferably, the active phase consists of nickel.

The content of metal from group VIII is of between 1% and 60% by weight of oxide of the metal from group VIII, with respect to the total weight of the catalyst, preferably between 5% and 30% by weight, very preferably between 5% and 20% by weight.

Preferably, the catalyst is characterized by a specific surface of between 5 $m^2/g$ and 400 $m^2/g$, preferably of between 10 $m^2/g$ and 250 $m^2/g$, preferably of between 20 $m^2/g$ and 200 $m^2/g$, very preferably of between 30 $m^2/g$ and 180 $m^2/g$. The specific surface is determined in the present invention by the B.E.T. method according to the standard ASTM D3663, as described in the work by Rouquerol F., Rouquerol J. and Sing K., *Adsorption by Powders and Porous Solids: Principles, Methodology and Applications*, Academic Press, 1999, for example by means of an Autopore III™ model device of the Micromeritics™ brand.

The pore volume of the catalyst is generally of between 0.4 $cm^3/g$ and 1.3 $cm^3/g$, preferably of between 0.6 $cm^3/g$ and 1.1 $cm^3/g$. The total pore volume is measured by mercury porosimetry according to the standard ASTM D4284 with a wetting angle of 140°, as described in the same work.

The tapped bulk density (TBD) of the catalyst is generally of between 0.4 g/ml and 0.8 g/ml, preferably of between 0.4 g/ml and 0.7 g/ml.

The TBD measurement consists in introducing the catalyst into a measuring cylinder, the volume of which has been determined beforehand, and then, by vibration, in tapping it until a constant volume is obtained. The bulk density of the tapped product is calculated by comparing the weight introduced and the volume occupied after tapping.

The catalyst can be in the form of cylindrical or multilobe (trilobe, quadrilobe, and the like) extrudates with a small diameter, or of spheres.

The oxide support of the catalyst is usually a porous solid chosen from the group consisting of: aluminas, silica, silica-aluminas and also titanium or magnesium oxides, used alone or as a mixture with alumina or silica-alumina. It is preferably chosen from the group consisting of silica, the family of transition aluminas and alumina silicas. Very preferably, the oxide support is constituted essentially of alumina, that is to say it comprises at least 51% by weight, preferably at least 60% by weight, very preferably at least 80% by weight, or even at least 90% by weight of alumina. It preferably consists solely of alumina. Preferably, the oxide support of the catalyst is a "high temperature" alumina, that is to say which contains theta-, delta-, kappa- or alpha-phase aluminas, alone or as a mixture, and an amount of less than 20% of gamma-, chi- or eta-phase alumina.

A very preferred embodiment of the invention corresponds to the use, for stage d), of a catalyst constituted of alumina and of nickel, said catalyst containing a content by weight, with respect to the total weight of catalyst, of nickel oxide, in NiO form, of between 5% and 20%, said catalyst having a specific surface between 30 $m^2/g$ and 180 $m^2/g$.

The catalyst of the hydrodesulfurization stage d) is characterized by a hydrodesulfurization catalytic activity generally of between 1% and 90%, preferentially of between 1% and 70% and very preferably of between 1% and 50% of the catalytic activity of the catalyst of the hydrodesulfurization stage c).

Stage e): Separation of the $H_2S$ [Optional]

This stage is carried out in order to separate the excess hydrogen and also the $H_2S$ formed during stages c) and d). Any method known to a person skilled in the art can be envisaged. According to a first embodiment, after the hydrodesulfurization stages c) and d), the effluent is cooled to a temperature generally of less than 80° C. in order to condense the hydrocarbons. The gas and liquid phases are subsequently separated in a separation drum. The liquid fraction, which contains the desulfurized gasoline and also a fraction of the $H_2S$ dissolved, is sent to a stabilization column or debutanizer. This column separates a top cut, constituted essentially of residual $H_2S$ and of hydrocarbon compounds having a boiling point less than or equal to that of butane, and a bottom cut freed from $H_2S$, referred to as stabilized gasoline, containing the compounds having a boiling point greater than that of butane. According to a second embodiment, after the condensation stage, the liquid fraction which contains the desulfurized gasoline and also a fraction of the $H_2S$ dissolved is sent to a stripping section, while the gaseous fraction, constituted mainly of hydrogen and of $H_2S$, is sent to a purification section. The stripping can be carried out by heating the hydrocarbon fraction, alone or with an injection of hydrogen or steam, in a distillation column in order to extract, at the top, the light compounds which were entrained by dissolution in the liquid fraction and also the dissolved residual $H_2S$. The temperature of the stripped gasoline recovered at the column bottom is generally of between 120° C. and 250° C.

Preferably, the separation stage e) is carried out in a stabilization column or debutanizer. This is because a stabilization column makes it possible to separate the $H_2S$ more efficiently than a stripping section.

Stage e) is preferably carried out in order for the sulfur in the form of $H_2S$ remaining in the desulfurized gasoline to represent less than 30%, preferably less than 20% and more preferably less than 10% of the total sulfur present in the treated hydrocarbon fraction.

Description of the Preparation of the Catalysts and of the Sulfidation

The preparation of the catalysts of stages c) and d) is known and generally comprises a stage of impregnation of the metals from group VIII and from group VIB, when it is present, and optionally of phosphorus and/or of the organic compound on the oxide support, followed by a drying operation and then by an optional calcination making it possible to obtain the active phase in their oxide forms. Before its use in a process for the hydrodesulfurization of a sulfur-containing olefinic gasoline cut, the catalysts are generally subjected to a sulfidation in order to form the active entity as described below.

The impregnation stage can be carried out either by slurry impregnation, or by impregnation in excess, or by dry impregnation, or by any other means known to a person skilled in the art. The impregnation solution is chosen so as to be able to dissolve the metal precursors in the desired concentrations.

Use may be made, by way of example, among the sources of molybdenum, of the oxides and hydroxides, molybdic acids and their salts, in particular the ammonium salts, such as ammonium molybdate or ammonium heptamolybdate, phosphomolybdic acid ($H_3PMo_{12}O_{40}$) and its salts, and optionally silicomolybdic acid ($H_4SiMo_{12}O_{40}$) and its salts. The sources of molybdenum can also be any heteropolycompound of Keggin, lacunary Keggin, substituted Keggin, Dawson, Anderson or Strandberg type, for example. Use is preferably made of molybdenum trioxide and the heteropolycompounds of Keggin, lacunary Keggin, substituted Keggin and Strandberg type.

The tungsten precursors which can be used are also well known to a person skilled in the art. For example, use may be made, among the sources of tungsten, of the oxides and hydroxides, tungstic acids and their salts, in particular the ammonium salts, such as ammonium tungstate or ammonium metatungstate, phosphotungstic acid and its salts, and optionally silicotungstic acid ($H_4SiW_{12}O_{40}$) and its salts. The sources of tungsten can also be any heteropolycompound of Keggin, lacunary Keggin, substituted Keggin or Dawson type, for example. Use is preferably made of the oxides and the ammonium salts, such as ammonium metatungstate, or the heteropolyanions of Keggin, lacunary Keggin or substituted Keggin type.

The cobalt precursors which can be used are advantageously chosen from the oxides, hydroxides, hydroxycarbonates, carbonates and nitrates, for example. Use is preferably made of cobalt hydroxide and cobalt carbonate.

The nickel precursors which can be used are advantageously chosen from the oxides, hydroxides, hydroxycarbonates, carbonates and nitrates, for example.

The preferred phosphorus precursor is orthophosphoric acid $H_3PO_4$ but its salts and esters, such as ammonium phosphates, are also suitable. The phosphorus can also be introduced at the same time as the element(s) from group VIB in the form of Keggin, lacunary Keggin, substituted Keggin or Strandberg-type heteropolyanions.

After the impregnation stage, the catalyst is generally subjected to a drying stage at a temperature of less than 200° C., advantageously of between 50° C. and 180° C., preferably between 70° C. and 150° C., very preferably between 75° C. and 130° C. The drying stage is preferentially carried out under an inert atmosphere or under an oxygen-containing atmosphere. The drying stage can be carried out by any technique known to a person skilled in the art. It is advantageously carried out at atmospheric pressure or at reduced pressure. Preferably, this stage is carried out at atmospheric pressure. It is advantageously carried out in a traversed bed using hot air or any other hot gas. Preferably, when the drying is carried out in a fixed bed, the gas used is either air or an inert gas, such as argon or nitrogen. Very preferably, the drying is carried out in a traversed bed in the presence of nitrogen and/or air. Preferably, the drying stage has a duration of between 5 minutes and 15 hours, preferably between 30 minutes and 12 hours.

According to an alternative form of the invention, the catalyst has not undergone calcination during its preparation, that is to say that the impregnated catalytic precursor has not been subjected to a stage of heat treatment at a temperature of greater than 200° C. under an inert atmosphere or under an oxygen-containing atmosphere, in the presence or absence of water.

According to another alternative form of the invention, which is preferred, the catalyst has undergone a calcination stage during its preparation, that is to say that the impregnated catalytic precursor has been subjected to a stage of heat treatment at a temperature of between 250° C. and 1000° C. and preferably between 200° C. and 750° C., for a period of time typically of between 15 minutes and 10 hours, under an inert atmosphere or under an oxygen-containing atmosphere, in the presence or absence of water.

Before bringing into contact with the feedstock to be treated in a process for the hydrodesulfurization of gasolines, the catalysts of the process according to the invention generally undergo a sulfidation stage. The sulfidation is preferably carried out in a sulforeducing medium, that is to say in the presence of $H_2S$ and of hydrogen, in order to transform the metal oxides into sulfides, such as, for example, $MoS_2$, $CoS_8$ or $Ni_3S_2$. The sulfidation is carried out by injecting, onto the catalyst, a stream containing $H_2S$ and hydrogen, or else a sulfur compound capable of decomposing to $H_2S$ in the presence of the catalyst and hydrogen. Polysulfides, such as dimethyl disulfide (DMDS), are $H_2S$ precursors commonly used to sulfide catalysts. The sulfur can also originate from the feedstock. The temperature is adjusted in order for the $H_2S$ to react with the metal oxides to form metal sulfides. This sulfidation can be carried out in situ or ex situ (inside or outside the reactor) of the reactor of the process according to the invention at temperatures of between 200° C. and 600° C. and more preferentially between 300° C. and 500° C.

The degree of sulfidation of the metals constituting the catalysts is at least equal to 60%, preferably at least equal to 80%. The sulfur content in the sulfided catalyst is measured by elemental analysis according to ASTM D5373. A metal is regarded as sulfided when the overall degree of sulfidation, defined by the molar ratio of the sulfur (S) present on the catalyst to said metal, is at least equal to 60% of the theoretical molar ratio corresponding to the complete sulfidation of the metal(s) under consideration. The overall degree of sulfidation is defined by the following equation:

$$(S/\text{metal})_{catalyst} \geq 0.6 \times (S/\text{metal})_{theoretical}$$

in which:

$(S/\text{metal})_{catalyst}$ is the molar ratio of the sulfur (S) to the metal which are present on the catalyst $(S/\text{metal})_{theoretical}$ is the molar ratio of the sulfur to the metal corresponding to the complete sulfidation of the metal to give sulfide.

This theoretical molar ratio varies according to the metal under consideration:

$(S/Fe)_{theoretical}=1$ $(S/Co)_{theoretical}=1$ $(S/Ni)_{theoretical}=1$ $(S/Mo)_{theoretical}=2/1$ $(S/W)_{theoretical}=2/1$ When the catalyst comprises several metals, the molar ratio of the S present on the catalyst to the combined metals also has to be at least equal to 60% of the theoretical molar ratio corresponding to the complete sulfidation of each metal to give sulfide, the calculation being carried out in proportion to the relative molar fractions of each metal.

Schemes which can be Employed within the Scope of the Invention

Different schemes can be employed in order to produce, at a lower cost, a desulfurized gasoline having a reduced content of mercaptans. The choice of the optimum scheme depends on the characteristics of the gasolines to be treated and to be produced and also on the constraints specific to each refinery.

The schemes described below are given by way of illustration without limitation.

With reference to FIG. 1 and according to an embodiment of the process according to the invention, the gasoline to be treated is sent via line 1 and hydrogen is sent via line 3 to a selective hydrogenation unit 2 (stage a)) in order to selectively hydrogenate the diolefins and to increase the molecular weight of the light mercaptans. The effluent having a low content of diolefins and mercaptans is withdrawn from the reactor 2 via the line 4 and is sent to a fractionation column 5 (stage b)) configured to separate the effluent and to obtain three distinct cuts: a gaseous fraction 8 which is constituted mainly of excess hydrogen and possibly of C1 to C4 light hydrocarbons, a light gasoline cut 10 (or light gasoline) and a heavy gasoline cut 11 which is constituted by the heavy fraction complementary to the light gasoline.

A condenser (not shown) and then a gas/liquid separator 7 makes it possible to condense and separate the C5+ compounds entrained by stripping in the gas phase discharged via the line 6 to create a liquid reflux 9 which is reinjected in its entirety at the column top. The light gasoline cut 10 is withdrawn in the upper part of the column in order to limit its vapor pressure, at the theoretical stage 27, the column comprising 30 theoretical stages, the theoretical stage 1 being the reboiler and the stage 30 being the condenser. The sulfur content of the light gasoline cut is less than 10 ppm by weight, with respect to the total weight of the light gasoline cut. The light gasoline cut obtained can be sent directly to the gasoline pool as fuel.

The heavy gasoline cut is subsequently sent via the line 11 and hydrogen is subsequently sent via the line 12 to the hydrodesulfurization unit 13 (stage c)). The hydrodesulfurization unit 13 of stage c) is, for example, a reactor containing a supported hydrodesulfurization catalyst based on a metal from group VIII and VIB in a fixed bed or in a fluidized bed; preferably, a fixed bed reactor is used. The reactor is operated under operating conditions and in the presence of a hydrodesulfurization catalyst as described above to decompose the sulfur compounds and to form hydrogen sulfide ($H_2S$). During the hydrodesulfurization in stage c), recombinant mercaptans are formed by addition of formed $H_2S$ to the olefins. The effluent from the hydrodesulfurization unit 13 is subsequently introduced into the "finishing" hydrodesulfurization unit 15 (stage d)) via the line 14 without removal of the $H_2S$ formed. The hydrodesulfurization unit 15 of stage d) is, for example, a reactor containing a hydrodesulfurization catalyst in a fixed bed or in a fluidized bed; preferably, a fixed bed reactor is used. The unit 15 is operated at a higher temperature than the unit 13 and in the presence of a selective catalyst comprising an oxide support and an active phase constituted of at least one metal from group VIII in order to decompose, at least in part, the recombinant mercaptans to give olefins and $H_2S$. It also makes it possible to hydrodesulfurize the more refractory sulfur compounds.

The desulfurized heavy gasoline cut is sent via the line 16 to a separation drum 17 (stage e)) in order to withdraw a gas phase containing $H_2S$ and hydrogen via the line 18 and a liquid fraction via the line 19. The liquid fraction, which contains the desulfurized heavy gasoline and also a fraction of the $H_2S$ dissolved, is sent via the line 19, optionally as a mixture with the light gasoline cut originating from the line 10, to a stabilization column or debutanizer 20 in order to separate, at the top of the column via the line 21, a stream containing $C_4$ hydrocarbons and the residual $H_2S$ and, at the bottom of the column via the line 22, either the stabilized and desulfurized heavy gasoline or the mixture of gasolines of the stabilized and desulfurized heavy and light cuts.

The examples below illustrate the invention without limiting the scope thereof.

EXAMPLES

The analytical methods used to characterize the feedstocks and effluents are as follows:

- density according to the NF EN ISO 12185 method;
- sulfur content according to the ASTM D2622 method for contents of greater than 10 ppm of S and the ISO 20846 method for contents of less than 10 ppm of S;
- content of mercaptans according to the ASTM D3227 method;
- distillation according to the CSD simulated distillation method according to the ASTM D2887 method;
- content of diolefins, determined via the maleic anhydride value (MAV), according to the UOP 326 method.

Example 1 (not in Accordance with the Invention)

Figure 2:
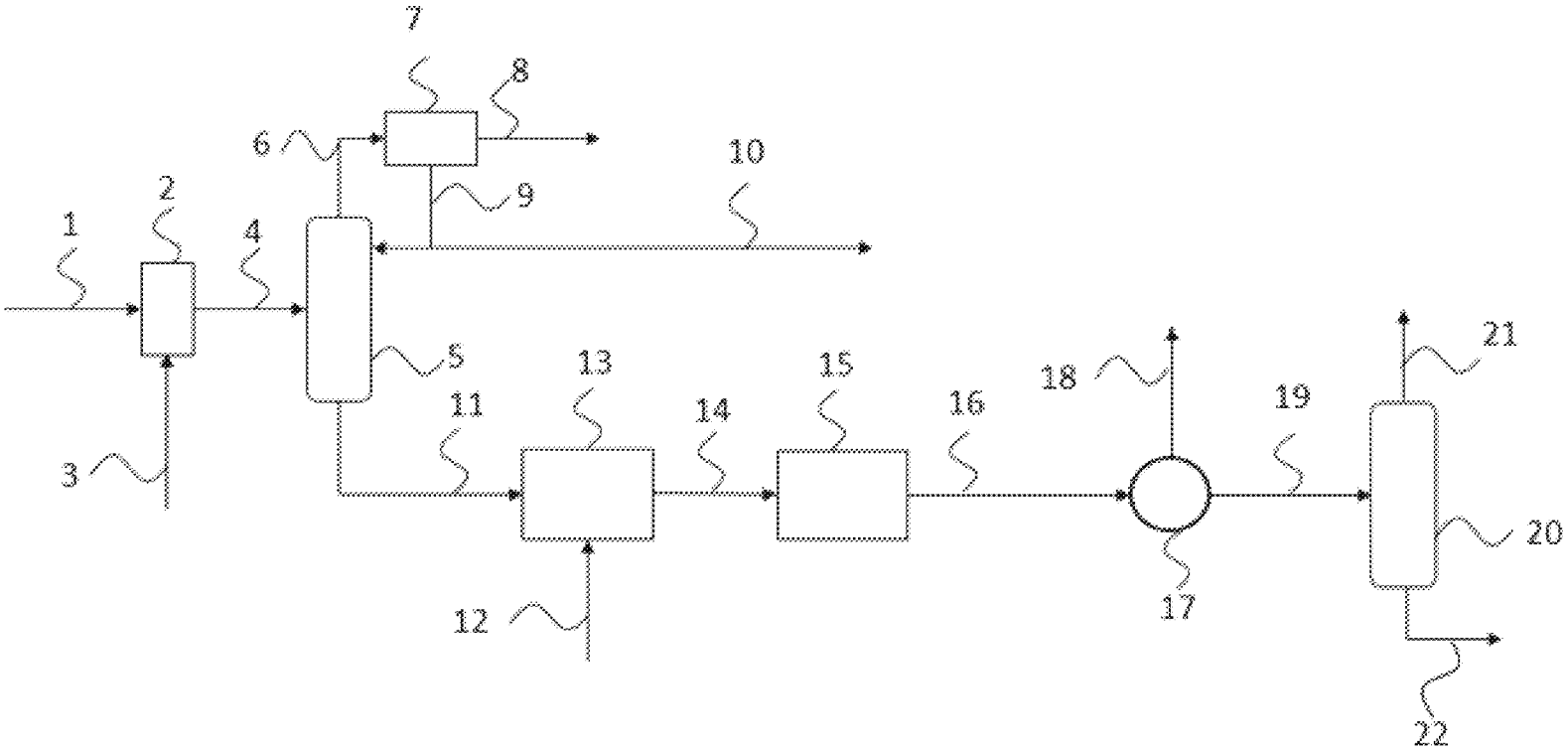
FIG. 2 is a diagrammatic representation of a process not in accordance with the invention.

The characteristics of an FCC gasoline treated by the process according to FIG. 2 are given in table 1. The FCC gasoline (line 1) is treated in the selective hydrogenation reactor 2 in the presence of a catalyst A. The catalyst A is a catalyst of NiMo-on-alumina type. The contents of metals are respectively 7% by weight of NiO and 11% by weight of $MoO_3$, with respect to the total weight of the catalyst, i.e. an Ni/Mo molar ratio of 1.2. The specific surface of the catalyst is 230 $m^2/g$. Prior to its use, the catalyst A is sulfided at atmospheric pressure in a sulfidation bed under an $H_2S/H_2$ mixture constituted of 15% by volume of $H_2S$ at 1 l/g·h of catalyst and at 400° C. for two hours. This protocol makes it possible to obtain a degree of sulfidation of greater than 80%.

The gasoline (line 1) is brought into contact with hydrogen (line 3) in a reactor which contains the catalyst A. This stage of the process carries out the selective hydrogenation of the diolefins and the conversion (increase in the molecular weight) of a part of the light C5-mercaptan (RSH) compounds present in the feedstock. The content of diolefins is directly proportional to the MAV (maleic anhydride value). The diolefins are undesirable compounds since they are precursors to gums in gasolines.

The operating conditions employed in the selective hydrogenation reactor are: Temperature: 150° C., Total pressure: 2.5 MPa, Added $H_2$/gasoline feedstock ratio by volume: 5 standard $m^3$ of hydrogen per $m^3$ of gasoline at standard conditions (vol/vol), Hourly space velocity (HSV): 3 $h^{-1}$.

TABLE 1

Characteristics of the feedstock (1) and of the selective hydrogenation effluent (4).

| | | Line 1 Feedstock | Line 4 Selective hydrogenation effluent |
|---|---|---|---|
| Content of organic sulfur | (ppm by weight of S) | 518 | 512 |
| MAV | (mg/g) | 13.3 | 2.1 |
| Content of olefins | (% by weight) | 50.4% | 49.1% |
| Content of light C5-mercaptans | (ppm by weight) | 27 | 1.55 |
| Simulated distillation (ASTM D2887) | | | |
| 5% by weight distilled | (° C.) | 23 | 23 |
| 50% by weight distilled | (° C.) | 73 | 73 |
| 95% by weight distilled | (° C.) | 145 | 145 |

The effluent from the selective hydrogenation stage (line 4) having a low content of conjugated diolefins (MAV=2.1 mg/g) and a low content of light mercaptans (the molecular weight of which was increased in the selective hydrogenation stage) is sent to a fractionation column 5 in order to produce a light gasoline (line 10) withdrawn at the level of the ref lux drum of the column, a heavy gasoline cut (line 11) at the column bottom and a gas stream (line 8) containing essentially hydrogen and the light C1-C4 hydrocarbons. The column operates at a pressure of 0.6 MPa and comprises 30 theoretical plates. The gas stream is obtained by condensation at a temperature of 65° C. of the gas phase produced at the top of the fractionation column (line 6) and then by gas/liquid separation which makes possible the removal of the light hydrocarbons and excess hydrogen originating from stage a), and the production of a liquid phase (line 9) constituted of the C5 hydrocarbons entrained by stripping at the column top which is returned in part as reflux to the column.

The characteristics of the light gasoline cut and of the heavy gasoline cut are shown in table 2. The light gasoline obtained (line 10) has a low sulfur content (less than 10 ppm by weight). The heavy gasoline cut corresponds to approximately 90% by weight of the gasoline, has a high sulfur content and requires an additional treatment before being incorporated in the gasoline pool.

TABLE 2

Characteristics of the light gasoline and heavy gasoline cuts after the stage of fractionation of the gasoline

| | | Line 10 Light gasoline | Line 11 Heavy gasoline | Line 8 Bleed gas |
|---|---|---|---|---|
| Percentage by weight of the cut | (%) | 7.7 | 91.6 | 0.7 |
| Content of organic sulfur | (ppm by weight of S) | 7 | 558 | — |
| Content of olefins | (% by weight) | 56.2% | 48.5% | — |
| Loss of C5+ in the bleed | (mol %) | — | — | 0.45 |
| Simulated distillation (ASTM D2887) | | | | |
| 5% by weight distilled | (° C.) | −25.8 | 11.0 | N/A* |
| 30% by weight distilled | (° C.) | 4.4 | 52.0 | N/A* |
| 50% by weight distilled | (° C.) | 25.6 | 71.6 | N/A* |
| 70% by weight distilled | (° C.) | 32.6 | 100.3 | |
| 95% by weight distilled | (° C.) | 43.0 | 158.3 | N/A* |

*N/A = Not Applicable

The light gasoline (line 10) produced according to the example not in accordance with the invention vaporizes at atmospheric pressure and at 20° C. (70% by weight of vaporization). An additional column to remove the dissolved hydrogen is thus necessary before feeding this light gasoline cut to storage.

Example 2 (not in Accordance with the Invention)

The characteristics of an FCC gasoline treated by the process according to FIG. 2 are given in table 3. The FCC gasoline (line 1) is treated in the selective hydrogenation reactor 2 in the presence of a catalyst B. The catalyst B is a catalyst of NiMo-on-alumina type. The contents of metals are respectively 7% by weight of NiO and 11% by weight of $MoO_3$, with respect to the total weight of the catalyst, i.e. an Ni/Mo molar ratio of 1.2. The specific surface of the catalyst is 68 $m^2$/g. Prior to its use, the catalyst B is sulfided at atmospheric pressure in a sulfidation bed under an $H_2S/H_2$ mixture constituted of 15% by volume of $H_2S$ at 1 l/g·h of catalyst and at 400° C. for two hours. This protocol makes it possible to obtain a degree of sulfidation of greater than 80%.

The gasoline (line 1) is brought into contact with hydrogen (line 3) in a reactor which contains the catalyst B. This stage of the process carries out the selective hydrogenation of the diolefins and the conversion (increase in the molecular weight) of a part of the light C5-mercaptan (RSH) compounds present in the feedstock. The content of diolefins is directly proportional to the MAV (maleic anhydride value). The diolefins are undesirable compounds since they are precursors to gums in gasolines.

The operating conditions employed in the selective hydrogenation reactor are: Temperature: 150° C., Total pressure: 2.5 MPa, Added $H_2$/gasoline feedstock ratio by volume: 5 standard $m^3$ of hydrogen per $m^3$ of gasoline at standard conditions (vol/vol), Hourly space velocity (HSV): 3 $h^{-1}$.

TABLE 3

Characteristics of the feedstock (1) and of the selective hydrogenation effluent (4).

| | | Line 1 Feedstock | Line 4 Selective hydrogenation effluent |
|---|---|---|---|
| Content of organic sulfur | (ppm by weight of S) | 518 | 512 |
| MAV | (mg/g) | 13.3 | 5.1 |
| Content of olefins | (% by weight) | 50.4% | 49.6% |
| Content of light C5-mercaptans | (ppm by weight) | 27 | 2.42 |
| Simulated distillation (ASTM D2887) | | | |
| 5% by weight distilled | (° C.) | 23 | 23 |
| 50% by weight distilled | (° C.) | 73 | 73 |
| 95% by weight distilled | (° C.) | 145 | 145 |

The effluent from the selective hydrogenation stage (line 4) having a lower content of conjugated diolefins (MAV=2.1 mg/g) and a lower content of light mercaptans (the molecular weight of which was increased in the selective hydrogenation stage) is sent to a fractionation column (5) in order to produce a light gasoline (line 10) withdrawn 5 plates under the column top, a heavy gasoline cut (line 11) at the column bottom and a gas stream (line 8) containing essentially hydrogen and the light C1-C4 hydrocarbons. The column operates at a pressure of 0.6 MPa and comprises 30 theoretical plates. The gas stream is obtained by condensation at a temperature of 65° C. of the gas phase produced at the top of the fractionation column (line 6) and then by gas/liquid separation which makes possible the removal of the light hydrocarbons and excess hydrogen originating from stage a), and the production of a liquid phase (line 9) constituted of the C5 hydrocarbons entrained by stripping at the column top which is returned in part as reflux to the column.

The characteristics of the light gasoline cut and of the heavy gasoline cut are shown in table 4. The light gasoline obtained (line 10) has a sulfur content of greater than 10 ppm by weight and does not make possible its incorporation in the gasoline pool. The heavy gasoline cut corresponds to approximately 70% by weight of the gasoline, has a high sulfur content and requires an additional treatment before being incorporated in the gasoline pool.

TABLE 4

Characteristics of the light gasoline and heavy gasoline cuts after the stage of fractionation of the gasoline

| | | Line 10 Light gasoline | Line 11 Heavy gasoline | Line 8 Bleed gas |
|---|---|---|---|---|
| Percentage by weight of the cut | (%) | 29 | 69.5 | 1.5 |
| Content of organic sulfur | (ppm by weight of S) | 12 | 731 | — |
| Content of olefins | (% by weight) | 63.3% | 43.7% | — |
| Loss of C5+ in the bleed | (mol %) | | | 0.86 |
| Simulated distillation | | | | |

TABLE 4-continued

Characteristics of the light gasoline and heavy gasoline cuts after the stage of fractionation of the gasoline

| | | Line 10 Light gasoline | Line 11 Heavy gasoline | Line 8 Bleed gas |
|---|---|---|---|---|
| (ASTM D2887) | | | | |
| 5% by weight distilled | (° C.) | −19.0 | 36.4 | N/A* |
| 30% by weight distilled | (° C.) | 22.7 | 64.7 | N/A* |
| 50% by weight distilled | (° C.) | 32.9 | 91.8 | N/A* |
| 70% by weight distilled | (° C.) | 40.2 | 113.7 | |
| 95% by weight distilled | (° C.) | 74.3 | 157.4 | N/A* |

*N/A = Not Applicable

Example 3 (in Accordance with the Invention)

This example refers to the present invention, according to FIG. 1. The selective hydrogenation stage is carried out under the same conditions as example 1 and while using the same selective hydrogenation catalyst as example 1, that is to say the catalyst A of NiMo-on-alumina type with a specific surface of the catalyst of 230 $m^2/g$.

The effluent from the selective hydrogenation stage of example 1 (line 4) having a low content of conjugated diolefins (MAV=2.1 mg/g) and a low content of light sulfur compounds (the molecular weight of which was increased in the selective hydrogenation stage) is sent to a fractionation column 5 in order to produce a light gasoline (line 10) withdrawn 5 plates under the column top, a heavy gasoline cut (line 11) at the column bottom and a gas stream (line 8) containing essentially hydrogen and the light C1-C4 hydrocarbons. The column operates at a pressure of 0.6 MPa. The column comprises 30 theoretical plates. The reboiling power is identical to that of example 1. The gas stream is obtained by condensation at a temperature of 65° C. of the gas phase produced at the top of the fractionation column (line 6) and then by gas/liquid separation which makes possible the removal of the light hydrocarbons and excess hydrogen originating from stage a), and the production of a liquid phase (line 9) constituted of the C5 hydrocarbons entrained by stripping at the column top which is returned as reflux to the column.

The characteristics of the light gasoline cut and of the heavy gasoline cut are shown in table 5. The light gasoline obtained (line 10) has a low sulfur content (less than 10 ppm by weight). The heavy gasoline cut, which corresponds to approximately 70% by weight of the gasoline, has a high sulfur content (728 ppm) and requires an additional treatment before being incorporated in the gasoline pool.

TABLE 5

Characteristics of the cuts: Light gasoline and heavy gasoline after stage b) according to the invention

| | | Line 10 Light gasoline | Line 11 Heavy gasoline | Line 8 Bleed gas |
|---|---|---|---|---|
| Percentage by weight of the cut | (%) | 29 | 70.2 | 0.8 |
| Content of organic sulfur | (ppm by weight of S) | 9 | 728 | — |

TABLE 5-continued

| Characteristics of the cuts: Light gasoline and heavy gasoline after stage b) according to the invention | | | | |
|---|---|---|---|---|
| | | Line 10 Light gasoline | Line 11 Heavy gasoline | Line 8 Bleed gas |
| Content of olefins | (% by weight) | 63.2% | 43.1% | — |
| Loss of C5+ in the bleed | (mol %) | — | — | 0.44 |
| Simulated distillation (ASTM D2887) | | | | |
| 5% by weight distilled | (° C.) | −19.0 | 36.4 | N/A* |
| 30% by weight distilled | (° C.) | 22.9 | 64.2 | N/A* |
| 50% by weight distilled | (° C.) | 32.0 | 91.8 | N/A* |
| 70% by weight distilled | (° C.) | 40.3 | 113.7 | |
| 95% by weight distilled | (° C.) | 70.4 | 157 | N/A* |

*N/A = Not Applicable

The light gasoline (line 10) produced according to example 3 does not vaporize at atmospheric pressure and at 20° C. and can thus be fed directly to storage.

The process according to example 3 makes it possible to obtain a light gasoline cut having a low sulfur content while maximizing the content of olefins in this cut. The amount of olefins in the heavy gasoline cut is thus minimized in order to limit the loss of octane number.

The invention claimed is:

1. A process for the production of a light gasoline comprising a sulfur content of less than 10 ppm by weight, with respect to the total weight of said light gasoline, starting from a gasoline containing sulfur compounds, olefins and diolefins, the process comprising at least the following stages:

a) a stage of selective hydrogenation so as to hydrogenate the diolefins and to carry out a reaction for increasing the molecular weight of a part of the sulfur compounds, in which process the gasoline and the hydrogen are brought into contact with a selective hydrogenation catalyst at a temperature of between 100° C. and 220° C., with a liquid space velocity of between 1 $h^{-1}$ and 7 $h^{-1}$ and a pressure of between 0.5 MPa and 5 MPa, and with a molar ratio of the hydrogen to the diolefins to be hydrogenated of greater than 1 mol/mol and less than 100 mol/mol, with a ratio of the hydrogen flow rate, expressed in standard $m^3$ per hour, to the flow rate of feedstock to be treated, expressed in $m^3$ per hour at standard conditions, of between 2 $Sm^3/m^3$ and 100 $Sm^3/m^3$, said selective hydrogenation catalyst comprising an active phase containing at least one metal from group VIB and at least one metal from group VIII and a porous support containing at least alumina, said catalyst comprising a specific surface of between 100 $m^2/g$ and 400 $m^2/g$, wherein the catalyst comprises nickel at a content by weight of nickel oxide, in NiO form, of between 1% and 12% and molybdenum at a content by weight of molybdenum oxide, in $MoO_3$ form, of between 6% and 18% and a nickel/molybdenum molar ratio of between 0.3 and 2.5, the metals being deposited on a support consisting of alumina;

b) a stage of separation of the effluent obtained on conclusion of stage a) into a gaseous fraction, a light gasoline cut and a heavy gasoline cut, said stage b) being carried out in a fractionation column comprising n plates, n being an integer of greater than or equal to 20, the first plate being the reboiler and the plate "n" being the condenser, it being understood that the light gasoline cut is withdrawn from said fractionation column at the plate "n-i", with i of between 1 and 10.

2. The process as claimed in claim 1, in which said fractionation column comprises between 20 and 100 plates.

3. The process as claimed in claim 1, in which said light gasoline cut is withdrawn from said fractionation column at the plate "n-i", with i of between 1 and 6.

4. The process as claimed in claim 1, in which said metal from group VIII is nickel.

5. The process as claimed in claim 1, in which said metal from group VIB is molybdenum.

6. The process as claimed in claim 1, wherein the metals constituting the catalyst have a degree of sulfidation of greater than 60%.

7. The process as claimed in claim 1, in which said catalyst comprises a specific surface of between 100 $m^2/g$ and 280 $m^2/g$.

8. The process as claimed in claim 1, which process additionally comprises a stage c) of hydrodesulfurization of the heavy gasoline HCN cut obtained on conclusion of stage b) in the presence of hydrogen and of a hydrodesulfurization catalyst comprising an oxide support and an active phase comprising a metal from group VIB and a metal from group VIII, at a temperature of between 210° C. and 320° C., at a pressure of between 1 MPa and 4 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$, so as to convert at least a part of the sulfur compounds into $H_2S$.

9. The process as claimed in claim 8, in which the hydrodesulfurization catalyst of stage c) comprises alumina and an active phase comprising cobalt, molybdenum and optionally phosphorus, said hydrodesulfurization catalyst containing a content by weight, with respect to the total weight of catalyst, of cobalt oxide, in CoO form, of between 0.1% and 10%, a content by weight, with respect to the total weight of catalyst, of molybdenum oxide, in $MoO_3$ form, of between 1% and 20%, a cobalt/molybdenum molar ratio of between 0.1 and 0.8 and a content by weight, with respect to the total weight of catalyst, of phosphorus oxide, in $P_2O_5$ form, of between 0.3% and 10%, when phosphorus is present, said catalyst having a specific surface of between 50 $m^2/g$ and 250 $m^2/g$.

10. The process as claimed in claim 8, which process additionally comprises a stage d) of finishing hydrodesulfurization of the effluent obtained on conclusion of stage c) without removal of the $H_2S$ formed, in the presence of hydrogen and of a hydrodesulfurization catalyst comprising an oxide support and an active phase constituted of at least one metal from group VIII, at a temperature of between 280° C. and 400° C., at a pressure of between 0.5 MPa and 5 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$.

11. The process as claimed in claim 10, in which the hydrodesulfurization catalyst of stage d) is constituted of alumina and of nickel, said hydrodesulfurization catalyst containing a content by weight, with respect to the total weight of catalyst, of nickel oxide, in NiO form, of between 5% and 20%, said hydrodesulfurization catalyst having a specific surface of between 30 $m^2/g$ and 180 $m^2/g$.

12. The process as claimed in claim 10, additionally comprising a stage e) of separation of the $H_2S$ formed and present in the effluent resulting from stage d).

13. The process as claimed in claim 1, in which the gasoline is a catalytic cracking gasoline.

14. The process as claimed in claim 1, in which said fractionation column comprises between 20 and 60 plates.

15. The process as claimed in claim 1, in which said light gasoline cut is withdrawn from said fractionation column at the plate "n-i", with i of between 3 and 6.

16. A process for the production of a light gasoline comprising a sulfur content of less than 10 ppm by weight, with respect to the total weight of said light gasoline, starting from a gasoline containing sulfur compounds, olefins and diolefins, the process comprising at least the following stages:

a) a stage of selective hydrogenation so as to hydrogenate the diolefins and to carry out a reaction for increasing the molecular weight of a part of the sulfur compounds, in which process the gasoline and the hydrogen are brought into contact with a selective hydrogenation catalyst at a temperature of between 100° C. and 220° C., with a liquid space velocity of between 1 $h^{-1}$ and 7 $h^{-1}$ and a pressure of between 0.5 MPa and 5 MPa, and with a molar ratio of the hydrogen to the diolefins to be hydrogenated of greater than 1 mol/mol and less than 100 mol/mol, with a ratio of the hydrogen flow rate, expressed in standard $m^3$ per hour, to the flow rate of feedstock to be treated, expressed in $m^3$ per hour at standard conditions, of between 2 $Sm^3/m^3$ and 100 $Sm^3/m^3$, said selective hydrogenation catalyst comprising an active phase containing at least one metal from group VIB and at least one metal from group VIII and a porous support containing at least alumina, said catalyst comprising a specific surface of between 100 $m^2/g$ and 400 $m^2/g$;

b) a stage of separation of the effluent obtained on conclusion of stage a) into a gaseous fraction, a light gasoline cut and a heavy gasoline cut, said stage b) being carried out in a fractionation column comprising n plates, n being an integer of greater than or equal to 20, the first plate being the reboiler and the plate "n" being the condenser, it being understood that the light gasoline cut is withdrawn from said fractionation column at the plate "n-i", with i of between 1 and 10;

c) a stage of hydrodesulfurization of the heavy gasoline HCN cut obtained on conclusion of stage b) in the presence of hydrogen and of a hydrodesulfurization catalyst comprising an oxide support and an active phase comprising a metal from group VIB and a metal from group VIII, at a temperature of between 210° C. and 320° C., at a pressure of between 1 MPa and 4 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$, so as to convert at least a part of the sulfur compounds into $H_2S$.

17. The process as claimed in claim 16, in which the hydrodesulfurization catalyst of stage c) comprises alumina and an active phase comprising cobalt, molybdenum and optionally phosphorus, said hydrodesulfurization catalyst containing a content by weight, with respect to the total weight of catalyst, of cobalt oxide, in CoO form, of between 0.1% and 10%, a content by weight, with respect to the total weight of catalyst, of molybdenum oxide, in $MoO_3$ form, of between 1% and 20%, a cobalt/molybdenum molar ratio of between 0.1 and 0.8 and a content by weight, with respect to the total weight of catalyst, of phosphorus oxide, in $P_2O_5$ form, of between 0.3% and 10%, when phosphorus is present, said catalyst having a specific surface of between 50 $m^2/g$ and 250 $m^2/g$.

18. The process as claimed in claim 16, which process additionally comprises a stage d) of finishing hydrodesulfurization of the effluent obtained on conclusion of stage c) without removal of the $H_2S$ formed, in the presence of hydrogen and of a hydrodesulfurization catalyst comprising an oxide support and an active phase constituted of at least one metal from group VIII, at a temperature of between 280° C. and 400° C., at a pressure of between 0.5 MPa and 5 MPa, with a space velocity of between 1 $h^{-1}$ and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$.

19. The process as claimed in claim 18, in which the hydrodesulfurization catalyst of stage d) is constituted of alumina and of nickel, said hydrodesulfurization catalyst containing a content by weight, with respect to the total weight of catalyst, of nickel oxide, in NiO form, of between 5% and 20%, said hydrodesulfurization catalyst having a specific surface of between 30 $m^2/g$ and 180 $m^2/g$.

20. The process as claimed in claim 18, additionally comprising a stage e) of separation of the $H_2S$ formed and present in the effluent resulting from stage d).

* * * * *